United States Patent [19]

Leising

[11] 3,987,757

[45] Oct. 26, 1976

[54] PAPER HANDLING IMPROVEMENTS IN RADIANT FUSER VIA CORRUGATION OF PAPER

[75] Inventor: Walter F. Leising, Rochester, N.Y.

[73] Assignee: Xerox Corporation, Stamford, Conn.

[22] Filed: Nov. 18, 1974

[21] Appl. No.: 524,429

[52] U.S. Cl. ..... 118/641; 219/216; 432/59

[51] Int. Cl.[2] ..... G03G 15/20

[58] Field of Search ..... 118/641, 60; 432/59, 432/60, 230, 228; 219/216

[56] References Cited

UNITED STATES PATENTS

| | | | |
|---|---|---|---|
| 3,076,083 | 1/1963 | Codichini et al. | 432/230 |
| 3,079,483 | 2/1963 | Codichini et al. | 432/230 |
| 3,272,643 | 9/1966 | Pasek et al. | 118/60 |
| 3,306,595 | 2/1967 | Eisner | 219/216 |
| 3,515,855 | 6/1970 | Mix, Jr. | 432/59 |
| 3,655,173 | 4/1972 | Costello | 432/230 |
| 3,811,828 | 5/1974 | Ohta et al. | 432/59 |
| 3,836,322 | 9/1974 | Harwig et al. | 432/59 |
| 3,849,905 | 11/1974 | Bierworth et al. | 432/59 |
| 3,874,892 | 4/1975 | McInally | 118/641 |
| 3,898,424 | 8/1975 | Thettu | 219/216 |

*Primary Examiner*—Mervin Stein
*Assistant Examiner*—Douglas Salser

[57] ABSTRACT

Apparatus for fixing toner images electrostatically adhered to copy paper or other suitable support material. The apparatus is characterized by the provision of a plurality of radiant energy sources through which the copy paper having the toner images thereon is moved such that the radiant heat energy softens the toner whereby the toner becomes impregnated in the paper fibers. The apparatus is further characterized by the provision of paper transport structure for moving the copy paper intermediate the radiant heat sources without physically contacting the sources, said transporting means comprising a first transport disposed adjacent the inlet to the fixing apparatus and a second transport disposed adjacent the outlet thereof.

6 Claims, 4 Drawing Figures

PAPER HANDLING IMPROVEMENTS IN RADIANT FUSER VIA CORRUGATION OF PAPER

BACKGROUND OF THE INVENTION

This invention relates generally to electrostatographic apparatus and, more particularly, to radiant energy apparatus for fixing toner images to a support member.

In the process of electrostatography, latent electrostatic images are formed on a support member, for example, plain paper with the subsequent rendering of the latent images visible by the application of electroscopic marking particles, commonly referred to as toner. The toner or powder images so formed vary in density in accordance with the magnitude of electrostatic charges forming the individual images.

The toner images can be fixed directly upon the support member on which they are formed or they can be transferred to another support member with subsequent fixing of the images thereto.

Fixing of toner images can be accomplished by various methods one of which is by the employment of thermal energy. In order to permanently fix or fuse toner images onto a support member by means of thermal energy it is necessary to elevate the temperature of the toner material to a point at which the constituents of the toner coalesce and become tacky or melt. This action causes the toner to be absorbed to some extent into the fibers of the paper. Thereafter, as the toner cools, solidification of the toner material occurs causing it to be firmly bonded to the support member. In the process of electrostatography, the use of thermal energy for fixing toner images is old and well known.

One aproach to thermal fixing or fusing of toner images onto a support member is to pass the support member with the toner images thereon past a source of radiant energy such that the image-bearing side of the support is opposite the source of radiation while the reverse side thereof is moved in contact with a support platen which may be heated.

It will be appreciated by those skilled in the art that during simplex (i.e. single-sided copying) operation, it is desirable to prevent contacting of the radiant heat source by the copy paper and the toner images otherwise the paper may become scorched and the toner would contaminate the energy source. Additionally, during duplex operation (i.e. copying on both sides of a support) of the type herein contemplated it is desirable to prevent the toner images from the first side of the copy paper offsetting to the platen and or belts which come in contact with the toner images which images are again softened by the energy sources employed.

Accordingly, it is the primary object of this invention to provide a new and improved radiant fuser for use in an electrostatographic apparatus.

It is a more particular object of this invention to provide, in a xerographic reproducing apparatus, a radiant fuser and method of fusing toner images to support sheets wherein transport means operatively associate with the fuser serve to transport the copy sheet and toner images carried thereby through the fuser without the components of the fuser being contacted by either the paper or the toner images.

Another object of the invention is to provide a new and improved radiant fuser and method of fusing toner images to support sheets wherein a first transport is provided for initially moving the copy sheets partially through the fuser without contacting the components thereof and a second transport cooperating with the first transport to move the copy sheet the rest of the way through the fuser without contacting the components of the fuser, particularly, by the trailing edge of the support sheet.

Still another object of the invention is to provide a new and improved fuser for fixing toner images to support sheets and the method of fusing toner images to support sheets wherein a first transport is provided for corrugating the copy paper to thereby increase the beam strength thereof along the axis of travel and to thereby control the leading edge of the support sheet during its movement through the fuser and means for maintaining the corrugations in the paper as the trailing edge of the support sheet moves through the fuser.

BRIEF SUMMARY OF THE INVENTION

Briefly, the above-cited objects are accomplished by the provision of a plurality of heat sources between which support sheets bearing toner images thereon are moved by a pair of transport mechanisms disposed, one adjacent the inlet to the fuser and one disposed adjacent the outlet thereof.

In the preferred embodiment of the invention the transport disposed adjacent the inlet of the fuser comprises a plurality of belts and a vacuum platen across which the belts move. Apertures provided in the vacuum platen are disposed intermediate the runs of the belts and are disposed sub-adjacent the plane of the belts such that the vacuum created thereacross acts to curve the copy paper intermediate the belts and in the direction of the platen while the portions of the paper contacting the belts remain substantially in the plane of the belts which are crowned by means of crowned rollers over which they pass. The foregoing has the effect of corrugating the support sheet which increases the beam strength of the support sheet thereby enabling the leading end of the support sheet to be cantilevered through the fuser intermediate the plural energy sources.

The transport disposed adjacent the outlet of the fuser comprises a first shaft carrying a plurality of crowned rolls and the second shaft carrying a plurality of discs which cooperate with the crowned rolls to maintain the corrugations in the paper for controlling movements of the trail end of the support sheet through the fuser. A pair of rolls having a straight nip which is in line with the nip formed by the crowned rolls and discs serves to move the copy sheets from the crowned roll and disc arrangement toward the outlet of the reproducing apparatus.

Further objects and advantages of the present invention will become apparent in view of the detailed description to follow when read in conjunction with the accompanying drawings wherein.

DETAILED DESCRIPTION OF THE PREFERRED EMBODIMENT

Figure 1:
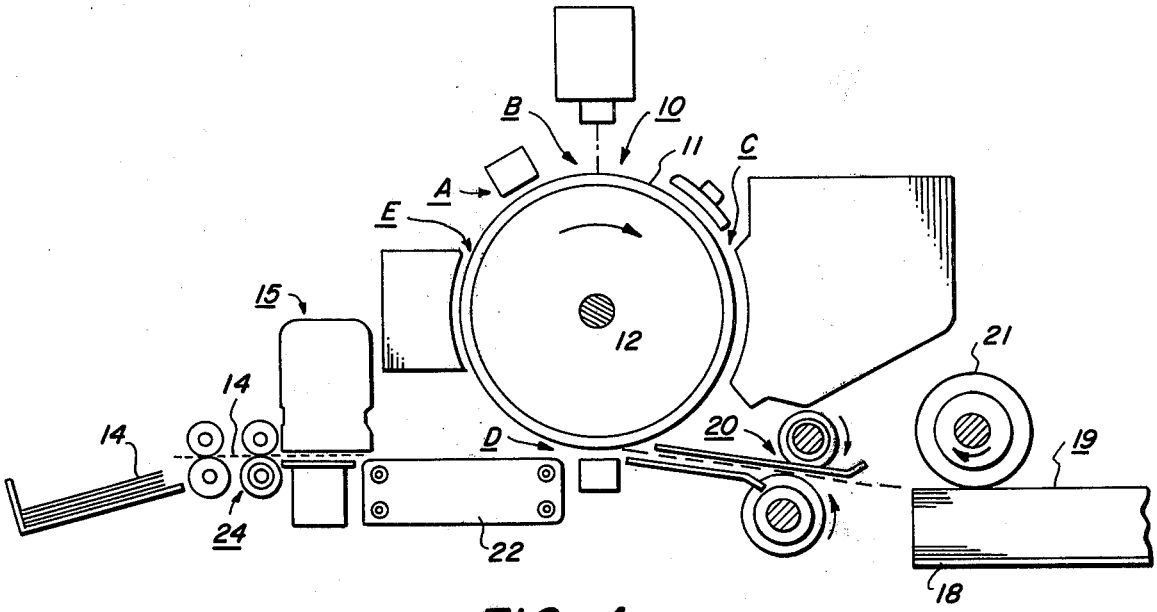
FIG. 1 is a schematic representation of a reproducing apparatus incorporating the invention.
Figure 4:
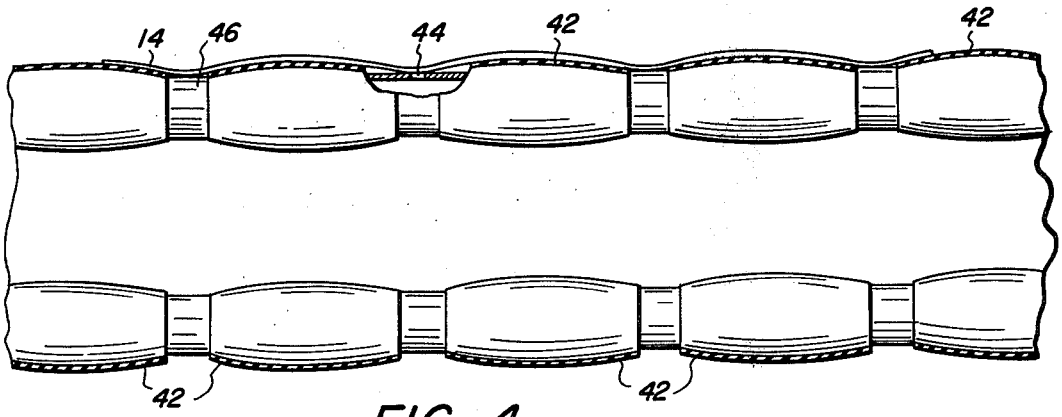
FIG. 4 is an end view of the fuser of FIG. 2.

Referring now to FIG. 1, there is shown by way of example an automatic xerographic reproducing machine 1 which incorporates the improved fusing apparatus 15 of the present invention. The reproducing machine 1 depicted in FIG. 1 illustrates the various components utilized therein for producing copies from an original. Although the fusing apparatus 15 of the present invention is particularly well adapted for use in an automatic xerographic reproducing machine 1 it should become evident from the following description that it is equally well suited for use in a wide variety of machines where an image is fused to a sheet of final support material and it is not necessarily limited in its application to the particular embodiment shown herein.

The reproducing machine 1 illustrated in FIG. 1 employs an image recording drum-like member 10 the outer periphery of which is coated with a suitable photoconductive material 11. One type of suitable photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 14 of final support material such as paper or the like.

Since the practice of xerography is well-known in the art, the various processing stations for producing a copy of an original are herein represented in FIG. 1 as blocks A to E. Initially, the drum 10 moves photoconductive surface 11 through charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described in U.S. patent application, Ser. No. 259,181 filed June 2, 1972.

After exposure, drum 10 rotates the electrostatic latent image recorded on the photoconductive surface 11 to development station C wherein a conventional developer mix is applied to the photoconductive surface 11 of the drum 10 rendering the latent image visible. A suitable development station is disclosed in U.S. patent application, Ser. No. 199,481 filed Nov. 17, 1971. The application describes a magnetic brush development system utilizing mix having granules and toner colorant. The developer mix is continuously brought through a directional flux field to form a brush thereof. The electrostatic latent image recorded on photoconductive surface 11 is developed by bringing the brush of developer mix into contact therewith.

The developed image on the photoconductive surface 11 is then brought into contact with a sheet 14 of final support material within a transfer station D and the toner image is transferred from the photoconductive surface 11 to the contacting side of the final support sheet 14. The final support material may be paper, plastic, etc. as desired. After the toner image has been transferred to the sheet of final support material 14, the sheet with the image thereon is advanced to a fuser assembly 15, which fixes the transferred powdered image thereto. After the fusing process, the sheet 14 is advanced through a snuffing apparatus 2 then by rolls 16 to a catch tray 17 for subsequent removal therefrom by the machine operator.

Although a preponderance of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example the use of a resiliently biased knife blade as set forth in U.S. Pat. No. 3,660,863 issued to Gerbasi in 1972.

If desired, in accordance with the invention, the sheets 14 of final support material processed in the automatic xerographic reproducing device can be stored in the machine within a removable paper cassette 18. A suitable paper cassette is set forth in U.S. patent application, Ser. No. 208,138 filed Dec. 15, 1971.

The reproducing apparatus in accordance with this invention can also have the capability of accepting and processing copy sheets 14 of varying lengths. The length of the copy sheet 14, of course, being dictated by the size of the original input scene or information recorded on the photoconductive surface 11. To this end the paper cassette 18 is preferably provided with an adjustable feature whereby sheets of varying length and width can be conveniently accommodated. In operation the cassette 18 is filled with a stack of final support material 19 of pre-selected size and the cassette 18 is inserted into the machine by sliding along a base plate (not shown) which guides the cassette into operable relationship with a pair of feed rollers 20. When properly positioned in communication with the feed rollers 20, the top sheet of the stack 19 is separated and forwarded from the stack 19 into the transfer station D by means of registration rolls 21.

It is believed that the foregoing description is sufficient for purposes of the present application to illustrate the general operation of the automatic xerographic reproducing machine 1 which can embody the teachings of the present invention.

Figure 2:
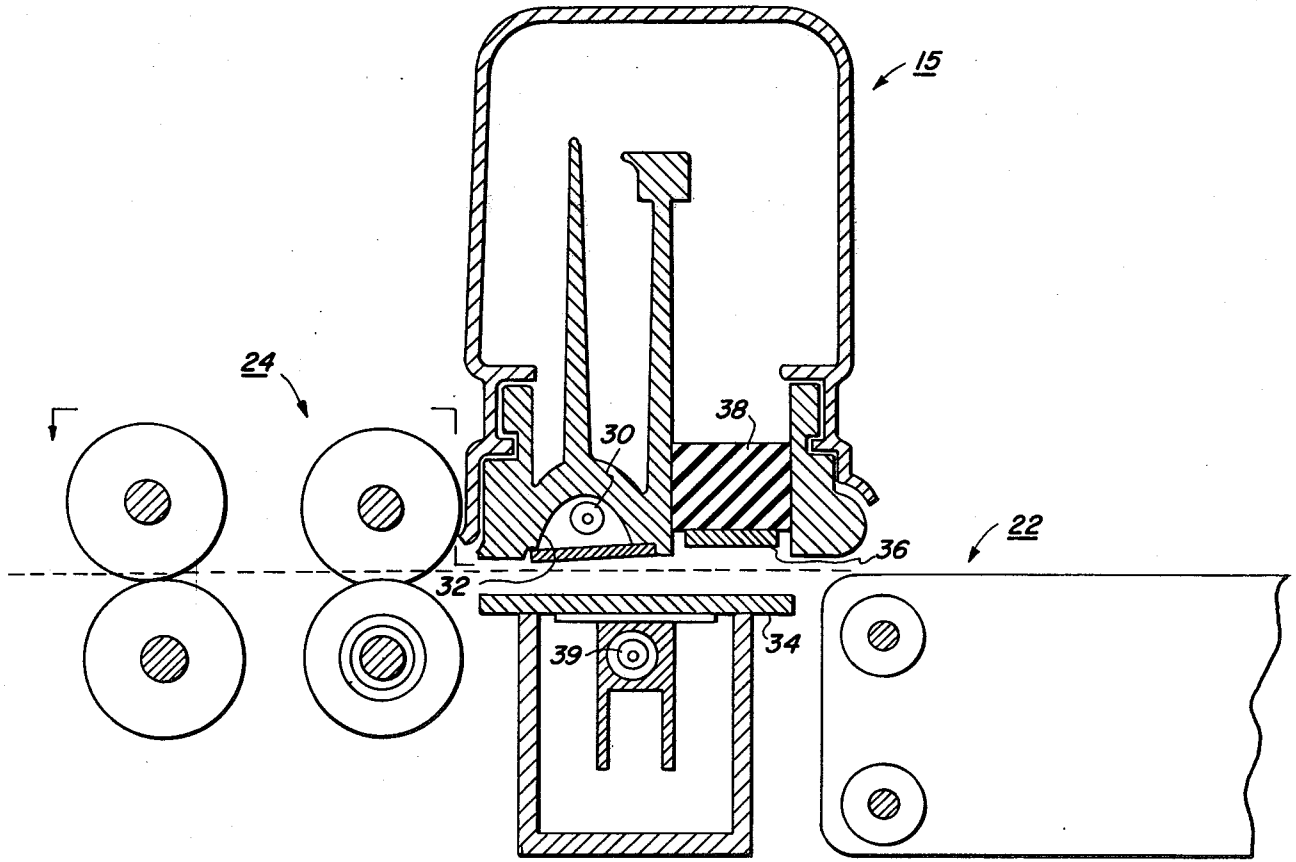
FIG. 2 illustrates schematically a sectional view in elevation, of a radiant fuser incorporated in the apparatus of FIG. 1.
Figure 3:
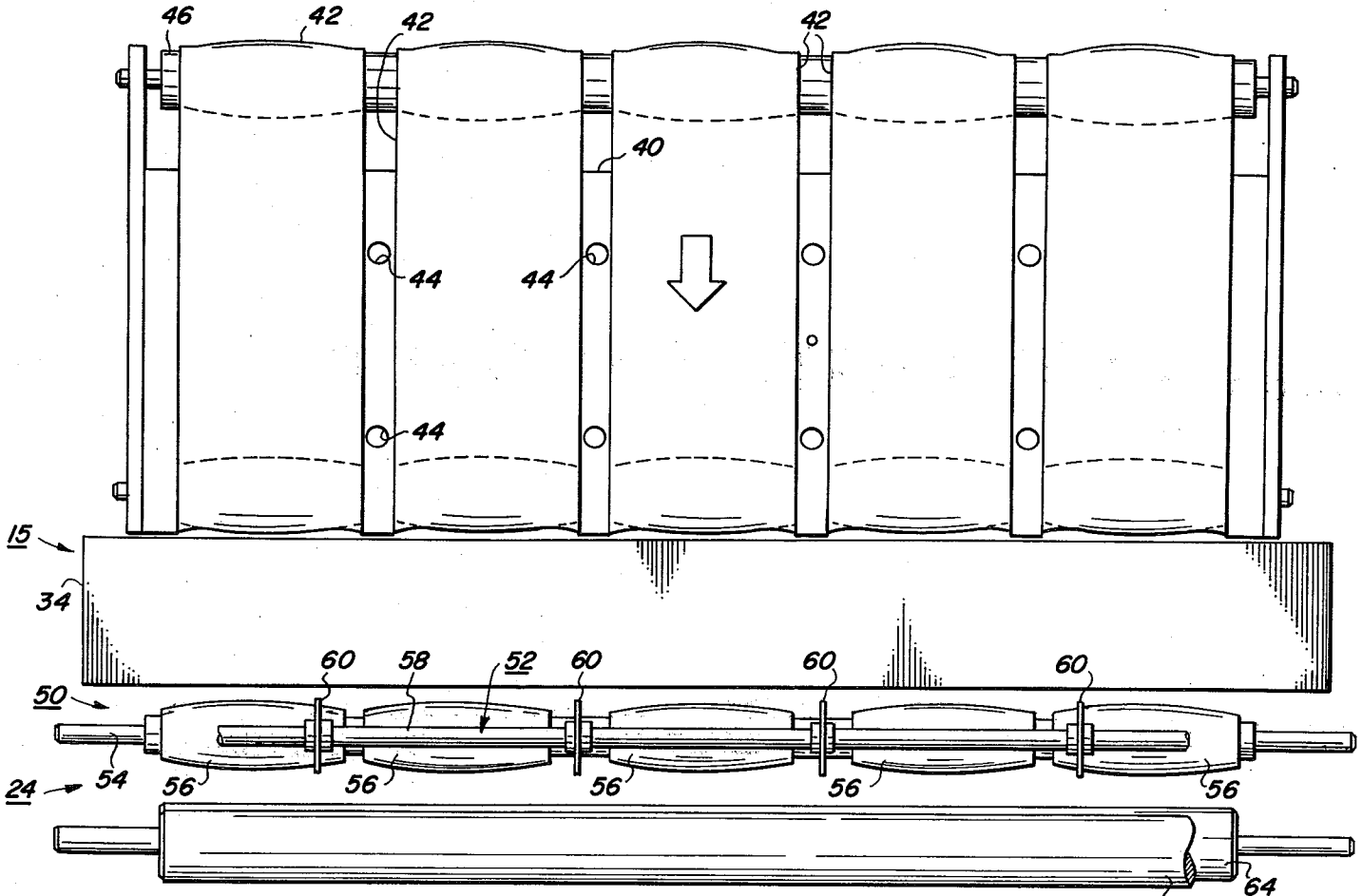
FIG. 3 is a view taken on the line 3—3 of FIG. 2.

Referring now to FIG. 2, that portion of the reproducing machine 1 of FIG. 1 embodying the fusing apparatus 15 of this invention is shown in greater detail. The image bearing sheet 14 after passing through the transfer station D of FIG. 1 upon separation from the photoconductive surface 11 is allowed to fall into contact with a vacuum belt transport system 22 which conveys the sheet directly to the fusing station 15.

The density of the toner images on the sheet 14 vary in accordance with the density of the electrostatic images formed thereon and therefore usually comprise high and low density images as well as background toner particles. Image density may be defined by the equation:

$$D = \log_{10} L_i / L_r$$

where $L_i$ = incident light on image and $L_r$ = reflected light by image.

From the foregoing it can be seen that when the reflected light is equal to the incident light the image density is equal to zero. Contrariwise, if none of the incident light is reflected by the image when the image density is equal to 1. In accordance with the foregoing, images whose density is equal to 1 are considered the highest density images and those whose densities are equal to 0.2 or less are considered low density images. Background toner particles, therefore, those toner particles which are on the copy paper but do not form a part of the images, have densities on the order of 0.05.

When the images have high densities (i.e. above 0.2) they act more like true black bodies with respect to radiant heat energy incident thereon, in that, they absorb a large percentage of that energy. A good source of radiant energy, that is one which converts a higher percentage of the available energy to radiant heat energy, will produce high intensity radiation concentrated about a wavelength at which peak power occurs. The higher the temperature of the source, the more concentrated will be the energy within a narrow band of wavelengths and the higher will be the intensity of the energy. A relationship also exists between the peak power wavelength and the source temperature. The higher the source temperature the closer the peak power wavelength is toward the shorter wavelength end of the spectrum useful for heating materials such as toner.

In accordance with the foregoing, a radiant energy source, for example, a quartz lamp 30 is provided which is designed to operate at a temperature of 2400°K at a power level of 850 watts. Quartz lamps for the purpose intended herein are well known, consequently, no further discussion thereof will be presented. Under these operating conditions, the quartz lamp will effectively fuse the high density images on a standard xerographic copy sheet 14. This has been found to be the case with papers on the order of 20 or less (basis weight 2000 sheets). The quartz lamp is mounted in a reflector assembly 32 in opposing relationship to a support platen 34 and in a position to thermally communicate with the toner images on the copy sheet 14.

By applying an additional amount of power to the lamp 30, fusing of low density images could be accomplished, however, papers lighter than 20# would experience scorching. Under certain conditions even the 20# paper can experience scorching at the elevated power level.

Accordingly, a second source of radiant energy is provided in the form of a resistance heater structure 36 which is designed to operate at 800° C at 300 watts of power. The heater structure 36 is fabricated from a material which has a thickness on the order of 1 mil and extends for a distance of approximately 1½ inches in the direction of travel of the copy sheet 14. The heater structure 36 constitutes a low mass source of radiant energy which has a very short warm-up period (on the order of 3 seconds). The structure 36 is fabricated from a stainless steel material wherein at least some of the chromium is replaced by cobalt. Such a material is available under the trade name Waspolloy, from Hamilton Metals Corp., a division of Hamilton Watch. Thermal insulation 38 is provided in order to retard energy losses from the heater structure 36. By provision of the heater structure 36, means for elevating the temperature of the paper in order to fuse low density images without fusing the background particles is available. It will be appreciated that the energy absorptance of the toner remains roughly the same for the different wavelengths, however, the paper absoptance increases to thereby adequately heat the paper and fuse low density images.

A heated platen heater 39 is also provided to assist the low mass source of radiant energy 36 in elevating the temperature of the paper for effecting fusing of low density images. To this end the heater 39 may provide as much as 30% of the energy required to elevate the paper to a suitable temperature.

Copy sheets 14 are introduced into the fusing apparatus 15 by the vacuum belt transport system 22 which may be considered an inlet transport while a transport mechanism generally indicated by the reference character 24 may be considered to be an outlet transport which cooperates, in a manner to be more fully described hereinafter, with the inlet transport system to control movement of copy sheets 14 through the fuser apparatus.

During such movement of the sheets 14 through the fuser it is desirable to effect downward curvature of the leading and trailing edge corners thereof. Such downward curvature minimizes the dynamic effects of the heating process which induce "corner lift" in the paper. It has been discovered that the foregoing controlled movement can be accomplished by corrugating the copy sheets such that the side edges of the copy sheet are concave up on the transport system 22. To this end, the inlet transport system 22 comprises a vacuum platen 40 and a plurality of belts 42 adapted to be moved thereacross in a crowned configuration with apertures 44 in the platen 40 being disposed intermediate the belts 42 and somewhat below the plane of the belts whereby vacuum from a source (not shown) exerts downward forces on copy sheets 14 at spaced intervals along the transverse dimension thereof. The crown-shaped belts serve to deform the copy sheets in the upward direction at spaced intervals which alternate with the deformations caused by the vacuum transport. To effect the crowning of the belts 42 a plurality of crowned rollers 46 with support shafts 48 therefor are provided at opposite ends of the vacuum platen. The net result of such an arrangement is to form the copy sheets as viewed from the leading edge thereof, into a sinusoidal configuration.

When the leading edge of a copy sheet 14 is on the platen and under the influence of the vacuum transport system the amplitude of the sinusoidal configuration is at a maximum. However, as the leading edge of a copy sheet leaves the platen and is cantilevered between the radiant sources 30, 36 and the heated platen 34 the corrugations spread out and decrease in amplitude. The decrease in amplitude which is accompanied by an increase in the period continues to decrease as the cantilevered distance increases. This is beleived to be caused by the elastic strength of the paper opposing the forces that induce the corrugations. Stable cantilevering distances on the order of 3 inches as measured from the inlet transport have been obtained with such an import transport system.

As the leading edge of a copy sheet moves out of the fuser apparatus 15 it is received by an overlapping pair of elements 50 and 52 which serve as guides which are matched to the peaks and valleys of the lead edge at this point. The element 50 comprises a shaft 54 having a plurality of crowned-shaped rollers 56 carried thereby. The element 52 comprises a shaft 58 having a plurality of discs 60 carried thereby. The discs and crowned rollers do not touch to form a defined nip and, consequently, are able to smoothly accomodate variations in the corrugation period of the lead edge. This pair of elements is designed to accomodate the lead edge corrugations but not to effect them appreciably (i.e., not to change the amplitude or period). The discs 60 may be repositionable on the shaft 58 to calibrate the element pair according to the period of the leading edge of the copy sheet. As the lead edge of a copy sheet travels beyond the elements 50 and 52 the lead edge tends to become virtually straight. At this point (total cantilivered distance approximately 4 inches) a pair of aluminum rolls 62 and 64 are engaged to form a straight nip. The straight nip of the rolls 62 and 64 and the overlapping nature of the first pair of output elements (i.e., elements 50 and 52) serve to maintain corrugations of the trail edge of a copy sheet 14. This provides corrugations that allow a smooth transition as the trail edge leaves the input transport and that also cantilever the trail edge through the fuser gap with the trail edge corners having a downward curvature exerted thereon.

While the invention has been described with respect to a specific embodiment it is not intended that the claims should be limited thereby.

What is claimed is:

1. Apparatus for fusing toner images to support members through the utilization of thermal energy, said apparatus comprising:

oppositely disposed sources of radiant energy forming a toner image fuser having an inlet and outlet;

first transport means disposed outside of said toner image fuser and adjacent said inlet for controlling movement of approximately the first half of a support member intermediate said radiant sources without contacting said sources; and second transport means diposed outside of said toner fuser and adjacent said outlet and cooperating with said first transport to complete movement of said support member through said fuser without touching of said sources by said support member and the toner images carried thereby.

2. Apparatus according to claim 1, wherein said first transport comprises means for corrugating said support members and said second transport means comprises means for complementing the corrugations in said support member as they move out of said fuser.

3. Apparatus according to claim 2, wherein said first transport comprises a plurality of crown-shaped belts and a vacuum platen having vacuum ports disposed intermediate said belts.

4. Apparatus according to claim 3, wherein said outlet transport comprises a first shaft carrying a plurality of discs and second shaft supporting a plurality of crowned rolls, said discs and said crowned rolls forming a non-linear nip therebetween corresponding substantially to the contour of said support members as they exit from said fuser.

5. Apparatus for fusing toner images to support members through the utilization of thermal energy, said apparatus comprising:

oppositely disposed means for providing energy for softening toner images, said means forming a fuser having an inlet and outlet;

first transport means disposed outside of said fuser and adjacent said inlet for controlling movement of approximately the first half of a support member intermediate said radiant sources without contacting said sources; and second transport means disposed outside of said fuser and adjacent said outlet and cooperating with said first transport to complete movement of said support member through said fuser without touching of said sources by said support member and the toner images carried thereby.

6. Apparatus for fusing toner images to support members through the utilization of thermal energy, said apparatus comprising:

a radiant fuser having an inlet and an outlet;

first transport means disposed outside of said fuser and adjacent said inlet for controlling movement of approximately the first half of the support member through said radiant fuser; and second transport means disposed outside of said fuser and adjacent said outlet and cooperating with said first transport to complete movement of said support member through said fuser without touching of source of heat of said fuser by said support member and the toner image is carried thereby, said first and second transport means being operative to initially control movement of a support first in a cantilevered fashion with the leading edge of said support being cantilevered and finally with the trailing edge being cantilevered.

* * * * *